US006092760A

United States Patent [19]

Hedrick

[11] Patent Number: 6,092,760

[45] Date of Patent: Jul. 25, 2000

[54] EASY ROLL

[76] Inventor: Renaya Willett Hedrick, P.O. Box 20061, Jean, Nev. 89019

[21] Appl. No.: 09/300,766

[22] Filed: Apr. 29, 1999

[51] Int. Cl.[7] ..... B65H 18/04

[52] U.S. Cl. ..... 242/598.3; 242/590; 242/599.3

[58] Field of Search ..... 242/598.3, 590, 242/599.3, 599.4, 599, 599.2, 613.5

[56] References Cited

U.S. PATENT DOCUMENTS

| | | | |
|---|---|---|---|
| 1,205,472 | 11/1916 | Moore | 242/160.1 |
| 1,618,342 | 2/1927 | Kirkman . | |
| 2,269,939 | 1/1942 | Janisch . | |
| 3,034,739 | 5/1962 | Barger . | |
| 3,038,598 | 6/1962 | Layton et al. | 206/58 |
| 3,156,425 | 11/1964 | Mynchenberg . | |
| 3,438,589 | 4/1969 | Jespersen . | |
| 3,848,822 | 11/1974 | Boone . | |
| 4,013,236 | 3/1977 | Perrin . | |
| 4,383,656 | 5/1983 | Campbell . | |
| 4,440,357 | 4/1984 | Vaughan . | |
| 4,487,378 | 12/1984 | Kobayashi . | |
| 4,671,466 | 6/1987 | Jespersen et al. . | |

*Primary Examiner*—Donald P. Walsh
*Assistant Examiner*—William A. Rivera
*Attorney, Agent, or Firm*—Patent & Trademark Services; Thomas Zack; Joseph H. McGlynn

[57] ABSTRACT

A toilet paper holder wherein the center cylindrically shaped housing acts to both hold the paper on one of its sides and to have two opposite flexible outwardly biased end members at its ends. Each of the flexible end members has a solid outwardly projecting tab that is rotatably retained within recesses of a conventional vertical stationary toilet roll mount. By making the housing for the toilet paper and the toilet paper holder the same, the conventional separately distinct roll holder component is eliminated. All of the material used for the housing, its flexible end members and the projecting tabs should be made of an inexpensive, biodegradable material such as cardboard.

6 Claims, 1 Drawing Sheet

FIG. 1
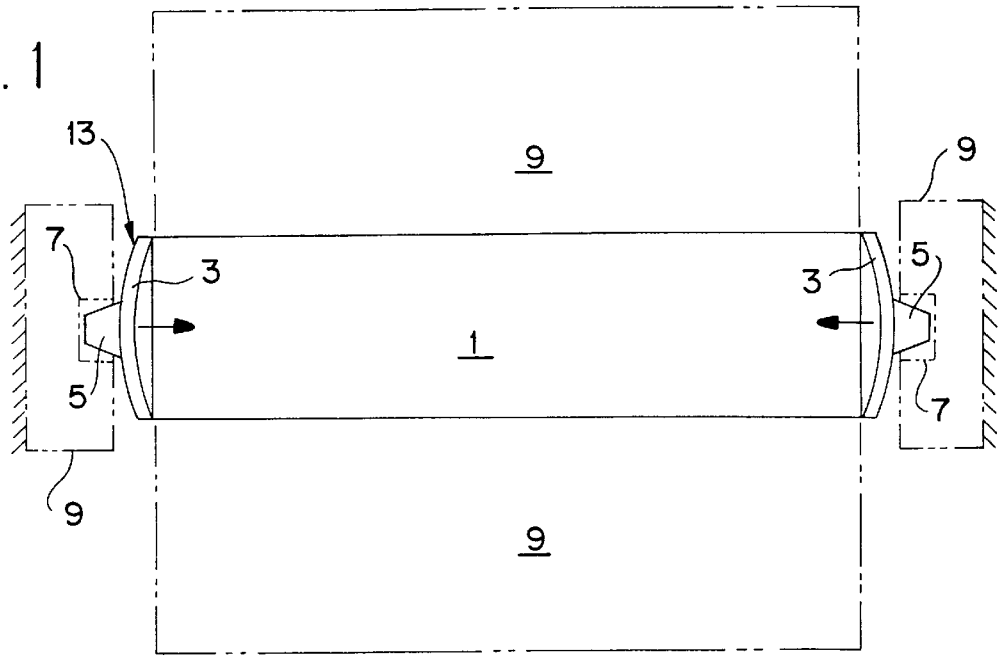
FIG. 2
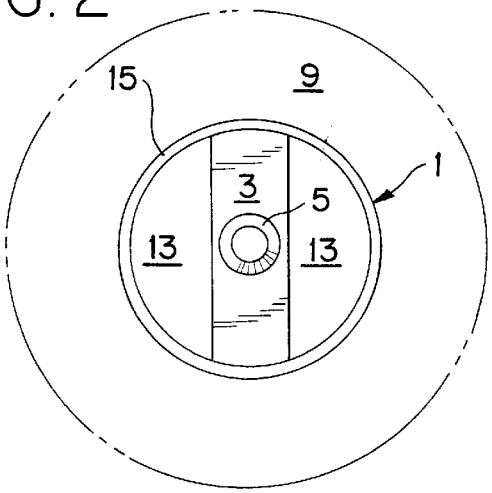
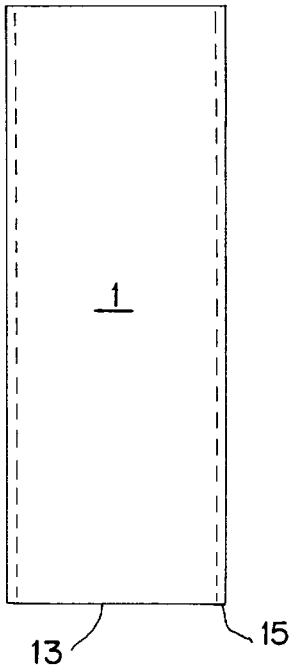
FIG. 3a
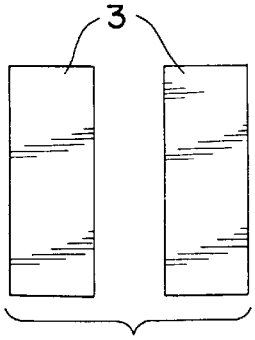
FIG. 3b
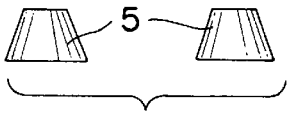
FIG. 3c

EASY ROLL

BACKGROUND OF THE INVENTION

Many convenient toilet or paper rolls are placed or replaced on cylindrical roll holder members that fit within a preformed center hole within the toilet or paper roll. Normally, spring biased members on the two opposite ends of the roll holder act to keep protruding end roll holder tab members in an extended position. By depressing one or both of these tab members, the roll holder may be rotatably horizontally mounted in a second holder for the roll holder which second holder is fixed to a vertical wall surface or other stationary surface. Thus, a user must first insert into the toilet paper's center hole the roll holder and then depress one of the tab members to mount the roll. This mounting procedure requires a certain degree of flubbing with both the toilet paper roll and its roll holder in order to mount both of them on the second holder. In addition to requiring some effort, there is always the possibility that the mobile detachable roll holder may be lost or stolen. Experience in hotels and motels has indicated an unwarranted disappearance of these toilet paper roll holders.

In the past other types of toilet paper roll holders have been proposed. With one earlier type end notches are formed on one end of the toilet paper roll which notches engage a male coupling member projecting from the periphery of a holding drum. In another earlier toilet paper roll, the paper adjacent the core is cut away to define a bearing wall that engages a supporting bearing. Still another type of roll towel dispenser utilizes a pair of diametrically aligned axial pin openings formed on one roll end surfaces. Mounted in these pin openings are two rotatably end roll holders at least one of which has inwardly facing members to engage a pair of pin end openings. A more recent coreless toilet paper roll has alternate radial corners and inwardly bulged portions.

The present invention relates to improved end mountings for a combined paper roll and its holder that is inexpensive to manufacture and totally compatible with existing stationary paper roll mounts to provide for the elimination of the conventional toilet or towel paper spring biased roll holder all as will be described in detail hereafter.

DESCRIPTION OF THE PRIOR ART

In the past other types of toilet or paper towel roll holders have been proposed. With one earlier type, as disclosed in the U.S. Pat. No. 1,205,472 to Moore, end notches are formed on one end of the toilet paper roll which notches engage a male coupling member projecting from the periphery of a holding drum.

In another earlier invention, U.S. Pat. No. 3,038,5982 to Layton et al., the paper adjacent the holed center core is cut away to define a bearing wall that engages a supporting bearing.

Still another type of roll towel dispenser (U.S. Pat. No. 4,013,236 to Perrin) utilizes a pair of diametrically aligned axial pin openings formed on one roll end surfaces. Mounted in these pin openings are two rotatably end roll holders at least one of which has inwardly facing members to engage a pair of pin end openings.

The more recent coreless toilet paper roll invention to Kobayashi (U.S. Pat. No. 4,487,378) has alternate radial corners and inwardly bulged portions.

The present invention relates to a toilet or paper roll holder wherein the roll is directly mounted on a stationary vertical holder by protruding thimble shaped end tabs that are fixed to outwardly extending ends members fixed to the paper roll all as more fully set forth in this specification.

SUMMARY OF THE INVENTION

This invention relates to paper roll holder having a cylindrically shaped hollow interior main member with two opposite bowed out end members that extend outwardly from the opened ends of the main member and are fixed to it at their edges. At approximately the centers of each of the two end members, are frusto conical shaped mount members that are fixed to the end member. These smaller end mount members are rotatably received within recesses of a conventional stationary paper roll holder mount.

It is the primary object of the present invention to provide for an improved holder to mount a roll of toilet paper or the like.

Another object is to provide for such a holder wherein end mounts are fixed to bowed out end members fixed to a main cylindrical member.

These and other objects and advantages of the present invention will become apparent to readers from a consideration of the ensuing description and the accompanying drawings.

BRIEF DESCRIPTION OF THE DRAWINGS

FIG. 1 is a side view of the invention's preferred embodiment showing it mounted in a roll of toilet paper with its two ends received with a conventional stationary roll holder mounts.

FIG. 2 is a end view of the FIG. 1 paper roll holder without the two roll holder mounts.

FIGS. 3(*a*),(*b*) and (*c*) are side views of the individual disassembled main cylindrical housing member, the two end members, and the two projecting frusto conical shaped smaller end tab members that engage the conventional stationary roll holder mounts, respectively.

DESCRIPTION OF THE PREFERRED EMBODIMENT

FIG. 1 is a side view of the invention's preferred embodiment showing it mounted to a roll of toilet paper with its two ends received within conventional stationary roll holder mounts. The hollow elongated cylindrically shaped main housing member 1 is normally made of an inexpensive biodegradable, and disposable material, such as cardboard or rigid paper. Its outer surface forms the same cylindrical surface found in the inner part of conventional rolls of toilet paper that is used to mount the successive layers of wound paper products on their outside while engage the roll holder on their inside surface. Extending from the opposite opened ends of member 1 are two substantially identical bowed out at mid length flexible second members 3. These two second members 3 are fixed to the main cylinder 1 at their opposite ends along the opened ends peripheral edges of the cylinder 1. Each member 3 has its bowed out middle portion extending away from the housing member 1. Extending further outwardly from the housing and second members 3 and fixed at their bowed out centers are two substantially identical solid frusto conical or thimble shaped projecting retaining tabs 5. These tabs 5 are normally smaller than the bowed out members 3 to which it is fixed. The smaller diameter outer free end surface of tabs 5 are pointed towards to the conventional stationary roll holder mount 9 to engage it. The end tabs are shaped and sized to be rotatably retained within two internal recesses 7 found in this toilet roll holder mount 9 (shown in dotted in format). Such conventional roller holder mounts are normally fixed to vertical supporting surfaces, such as side bathroom walls or vanities adjacent to toilets. Since the two normally bowed out side members 3 have an inherent degree of material flexibility, one or both of them may be depressed inwardly slightly in the direction of the arrows to accommodate slight distance variations between the fixed distance between the two holder end receiving aligned recesses 7 and the overall length of the holder as measuring from the free ends of the tabs. After the side members are slightly depressed inwardly, see arrows, each of the flexible side members 3 and their extending end tabs 5 will spring back to their original positions to act as biased retaining members that are rotatably retained by the stationary mount holder within the two mounting side fixed recesses 7. Also shown in dotted line format in this figure is a conventional roll of toilet paper 9 with its normal center cardboard cylinder 1. In this embodiment, the conventional cardboard cylindrical center member is formed by the same cylinder used for the main cylinder 1 previously described. The cylindrically shaped lengthwise center cylinder hole 13 is surrounded by the main cylinder 1, except for the cylinder's two opposite opened ends, and the hole 13 extends in the same lengthwise direction as the housing. If it is manufacturing and cost expedient, the main holder 1 could, alternately, be separately manufactured as a smaller diameter cylinder and then inserted within the larger cylindrical center hole of a conventional cardboard roll of toilet paper and bonded to the roll at the mating cylindrical surfaces.

FIG. 2 is a end view of the FIG.1 paper roll holder with the mounted roll of conventional toilet paper 9 but without the two stationary end wall mounts. The main holder cylinder 1 for the paper has the hollow center hole 13 that extends the total length of the member 1. The thickness 15 of the cylinder's wall forming member 1 is used to provide two opposite end edge surfaces to which the hole 13 diameter spanning member 3 is fixed to at its opposite ends. Since members 3 when mounted to a vertical are directly horizontally aligned with each other with one behind the other, only one of them is visible in this view it being understood that the other one is fixed to the opened end edges of cylinder 1 in the same manner.

FIGS. 3(*a*),(*b*) and (*c*) are side views of the individual disassembled main cylindrical member 1, the two end members 3, and the two solid frusto conical shaped smaller end members 5 that engage the conventional stationary roll holder mounts, respectively. All of these individual members are made of inexpensive, biodegradable and disposal material, such as cardboard, that can be safety disposed of when the toilet paper runs out. When so disposed of their disposal will be environmentally friendly. Since the holder 1 with its sub components 3 and 5 fixed to it are relatively inexpensive to manufacture, they have the added advantage that they are less likely to be stolen or lost as one would have to take both the the whole roll of toilet paper and holder as a single unit. Compared to the conventional toilet roll holder with their two internal biasing springs and plastic, metallic or ceramic cylindrical construction, the combined toilet paper roll and holder of this invention is not only less expensive to make but has the added advantage of eliminating the conventional holder roller as a separate component.

Conceivably the combined toilet paper holder and mount receiving holder could be used with any of type of disposal material such as paper towels or disposal rolled plastic bags when it is desired to reduce total cost and the number of separate components involved in the operation.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A roll mount for disposal material wound thereon comprising:

an elongated cylindrically shaped main housing having a diameter, a first end and a second end opposite end with disposal material wound directly around the outer surface of the cylinder between said first end and second end;

flexible end members fixed on said housing's first end and second end and outwardly biased to extend outwardly from said housing two ends, each of said end members extending across the diameter of said housing;

two protruding biased retaining tab members one of which is fixed to each of said flexible two end members to extend further away from said housing than said end members, said tab members being adapted to be rotatably retained by internal recesses on a stationary vertical mount; and a stationary vertical mount having tab receiving recesses thereon to rotatably retain the ends of said tabs and the flexible end members and housing fixed thereon, wherein said housing, flexible end members and protruding tab members are all made of a cardboard material.

2. The roll mount as claimed in claim 1, wherein said housing has a hollow center extending the entire length of the housing with two opposite opened ends.

3. The roll mount as claimed in claim 2, wherein said disposal material is a toilet paper roll.

4. The roll mount as claimed in claim 3, wherein flexible end members are fixed to said housing at the peripheral edge surfaces of the housing's opened ends and bowed out away from the housing along approximately the middle of their respective lengths.

5. The roll mount as claimed in claim 4, wherein tab members are fixed to each of said flexible two end members at approximately their mid lengths, said tabs being made of a solid material.

6. The roll mount as claimed in claim 5, wherein tab members are made of solid material and frusto conical in shape with their smaller diameter ends being their free ends.

* * * * *